US005806850A

United States Patent [19]

Yoneoka et al.

[11] Patent Number: 5,806,850

[45] Date of Patent: Sep. 15, 1998

[54] SHEET SORTER

[75] Inventors: Hideharu Yoneoka, Tokyo; Hiroshi Saito, Yamanashi-ken, both of Japan

[73] Assignee: Riso Kagaku Corporation, Tokyo, Japan

[21] Appl. No.: 855,641

[22] Filed: May 13, 1997

[30] Foreign Application Priority Data

May 13, 1996 [JP] Japan ..... 8-117516

[51] Int. Cl.[6] ..... B65H 39/10; B65H 43/00; B65H 39/055

[52] U.S. Cl. ..... 271/296; 271/300; 271/302; 271/176; 270/58.18

[58] Field of Search ..... 270/58.14, 58.18, 270/58.2; 271/296, 288, 300, 176, 256, 258.01, 259

[56] References Cited

U.S. PATENT DOCUMENTS

| | | | |
|---|---|---|---|
| 4,285,508 | 8/1981 | Kaneko | 271/296 |
| 4,344,614 | 8/1982 | Kaneko et al. | 271/288 |
| 4,439,865 | 3/1984 | Kikuchi et al. | 271/296 |
| 4,445,680 | 5/1984 | Kikuchi et al. | 271/296 |
| 4,913,426 | 4/1990 | Kaneko | 271/300 |
| 5,137,266 | 8/1992 | Mori et al. | 270/58.14 |
| 5,632,479 | 5/1997 | Kubota et al. | 271/300 |

*Primary Examiner*—William E. Terrell
*Assistant Examiner*—Patrick MacKey
*Attorney, Agent, or Firm*—Sixbey, Friedman, Leedom & Ferguson, P.C.; Gerald J. Ferguson, Jr.

[57] ABSTRACT

A sheet resident space is provided on an indexer of a sheet transfer system, and a controller stops the image recording apparatus upon detection of a sheet jam about the indexer and stops the sheet transfer system after keeping it operating for a predetermined time interval sufficient for the sheet transfer system to transfer all the sheets in the sheet transfer passage thereof to the sheet resident space.

17 Claims, 10 Drawing Sheets

SHEET SORTER

BACKGROUND OF THE INVENTION

1. Field of the Invention

This invention relates to a sheet sorter which is provided with a plurality of bins each of which receives a plurality of sheets discharged from an image recording apparatus such as a printer, a copier or the like and forms thereon a stack of sheets, a sheet transfer means which transfers the sheets discharged from the image recording apparatus, and an indexer which receives the sheets from the sheet transfer means and is movable up and down along the array of sheet inlet ends of the bins to distribute the sheets to the respective bins through the sheet inlet ends thereof.

2. Description of the Related Art

As disclosed, for instance, in Japanese Unexamined Patent Publication No. 4(1992)-43089, there has been known a sheet sorter in which a plurality of recorded sheets discharged from an image recording apparatus such as a printer, a copier or the like are distributed to a plurality of bins in sequence to form a stack of sheets on each bin. Such a sheet sorter is provided with a sheet transfer system which transfers the sheets discharged from the image recording apparatus and an indexer which receives the sheets from the sheet transfer system and is movable up and down along the array of sheet inlet ends of the bins to distribute the sheets to the respective bins through the sheet inlet ends thereof.

Conventionally, in such a sheet sorter, when a sheet jam takes place about the indexer and is detected, the image recording apparatus is stopped and also the sheet transfer system is stopped.

Accordingly there has been a problem that all the sheets in the sheet transfer passage must be removed when settling the sheet jam about the indexer.

SUMMARY OF THE INVENTION

In view of the foregoing observations and description, the primary object of the present invention is to provide a sheet sorter in which all the sheets in the sheet transfer passage of the sheet transfer system can be removed in a lump in case a sheet jam takes place about the indexer.

The sheet sorter in accordance with a first aspect of the present invention comprises a plurality of bins arranged in a vertical direction each of which receives a plurality of sheets discharged from an image recording apparatus and forms thereon a stack of sheets, a sheet transfer system which transfers the sheets discharged from the image recording apparatus, and an indexer which is movable up and down along the array of sheet inlet ends of the bins to distribute the sheets from the sheet transfer system to the respective bins through the sheet inlet ends thereof and is characterized by a sheet resident space provided on the indexer, and a control means which stops the image recording apparatus upon detection of a sheet jam about the indexer and stops the sheet transfer system after keeping it operating for a predetermined time interval sufficient for the sheet transfer system to transfer all the sheets in the sheet transfer passage thereof to the sheet resident space.

The sheet sorter in accordance with a second aspect of the present invention comprises a plurality of bins arranged in a vertical direction each of which receives a plurality of sheets discharged from an image recording apparatus and forms thereon a stack of sheets, a sheet transfer system which transfers the sheets discharged from the image recording apparatus, and an indexer which is movable up and down along the array of sheet inlet ends of the bins to distribute the sheets from the sheet transfer system to the respective bins through the sheet inlet ends thereof and is characterized by a sheet resident space provided on the indexer, and a control means which stops the image recording apparatus and the sheet transfer system upon detection of a sheet jam about the indexer, blocks the sheet discharge port of the indexer, restarts the sheet transfer system upon receipt of a signal representing that the sheet jam is settled and a signal representing that the sheet discharge port of the indexer is blocked, and keeps the sheet transfer system operating for a predetermined time interval sufficient for the sheet transfer system to transfer all the sheets in the sheet transfer passage thereof to the sheet resident space.

The sheet resident space may be defined, for instance, by a guide member of the indexer which supports the under side of the sheet and guides the sheet into the bin and a pair of side frames which are disposed on opposite sides of the guide member and extend higher than the guide surface of the guide member.

It is preferred that said predetermined time interval be determined according to the position of the indexer at the time the sheet jam is detected.

It is preferred that the control means moves the indexer to a position where the sheet discharge port thereof is blocked by the bottom of the bin into which the indexer was about to release the sheet upon detection of the sheet jam and holds the indexer in the position until that there remains no sheet in the sheet resident space and/or the sheet transfer passage of the sheet transfer system is confirmed.

Further it is preferred that the control means moves the indexer to the blocking position immediately after detection of the sheet jam, though the control means may move the indexer to the blocking position after the sheet jammed in the indexer is removed and before the sheet transfer system is restarted in the case of the sheet sorter of the second aspect.

Further it is preferred that the sheet inlet end of each bin be provided with an erected surface.

The erected surface may double as a means for defining a reference surface on which the trailing edges of the sheets stacked in each bin are aligned with each other.

In accordance with the present invention, when a sheet jam takes place about the indexer, the sheet transfer system is operated for a predetermined time interval so that all the sheets in the sheet transfer passage are collected in the sheet resident space though the sheet recording apparatus is immediately stopped. Accordingly all the sheets in the sheet transfer passage can be removed in the lump without removing them one by one.

Further by setting the predetermined time according to the position of the indexer, loss time can be shortened. That is, when the predetermined time interval is set so that all the sheets in the sheet transfer passage are collected in the sheet resident space even if the indexer is in its lowermost position, the sheet sorter must wait in vain when the indexer is in its uppermost position upon occurrence of the sheet jam.

Further by moving down the indexer to a position where the sheet discharge port is blocked by the bottom of the bin as soon as a sheet jam takes place and holding the indexer in the position until that there remains no sheet in the sheet resident space and/or the sheet transfer passage of the sheet transfer system is confirmed, a sheet which has been left in the sheet resident space and/or the sheet transfer passage is prevented from being released into a bin by accident.

DESCRIPTION OF THE PREFERRED EMBODIMENT

Figure 1:
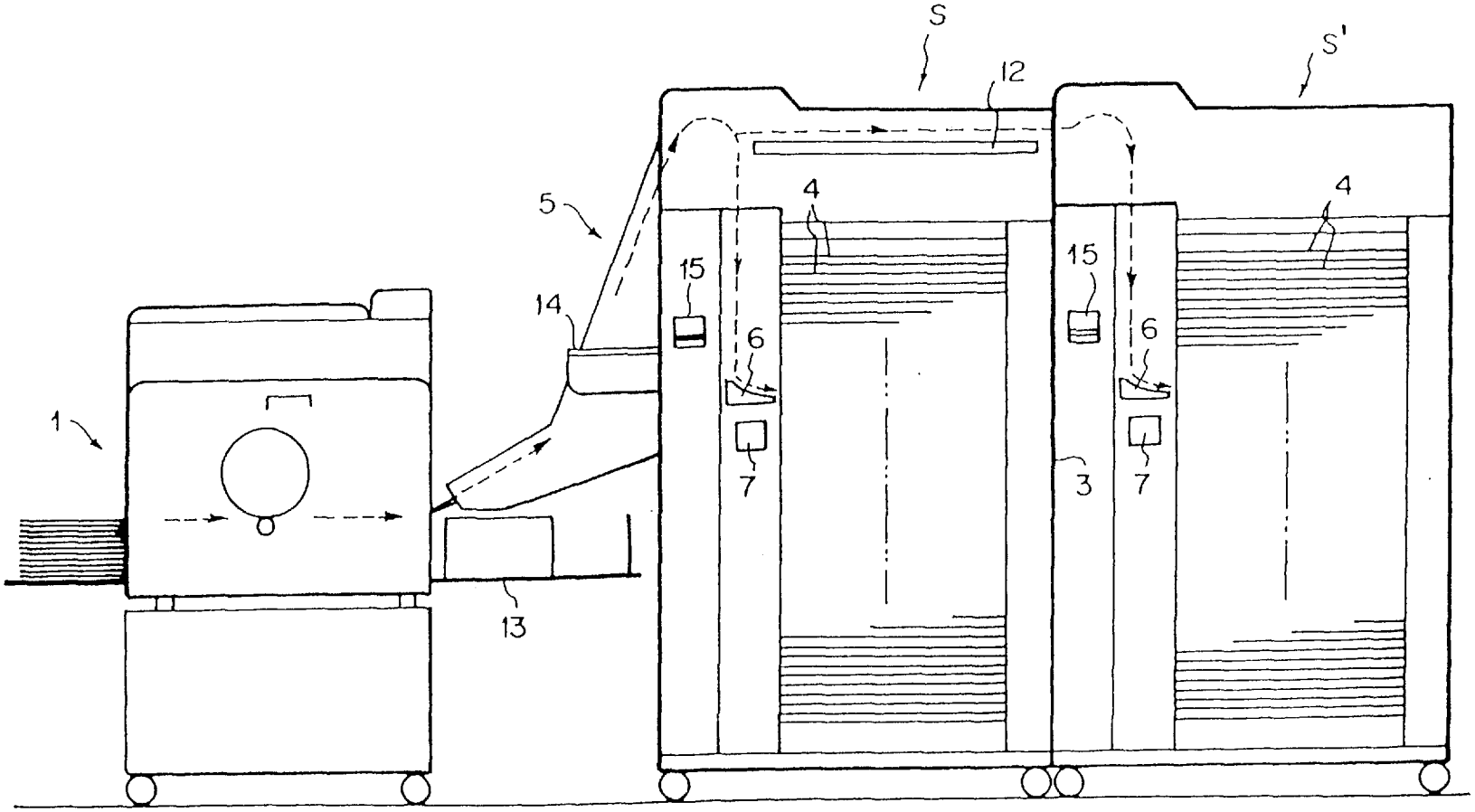
FIG. 1 is a schematic side view showing a sheet sorter in accordance with a first embodiment of the present invention with the sorter connected to an image recording apparatus.
Figure 2:
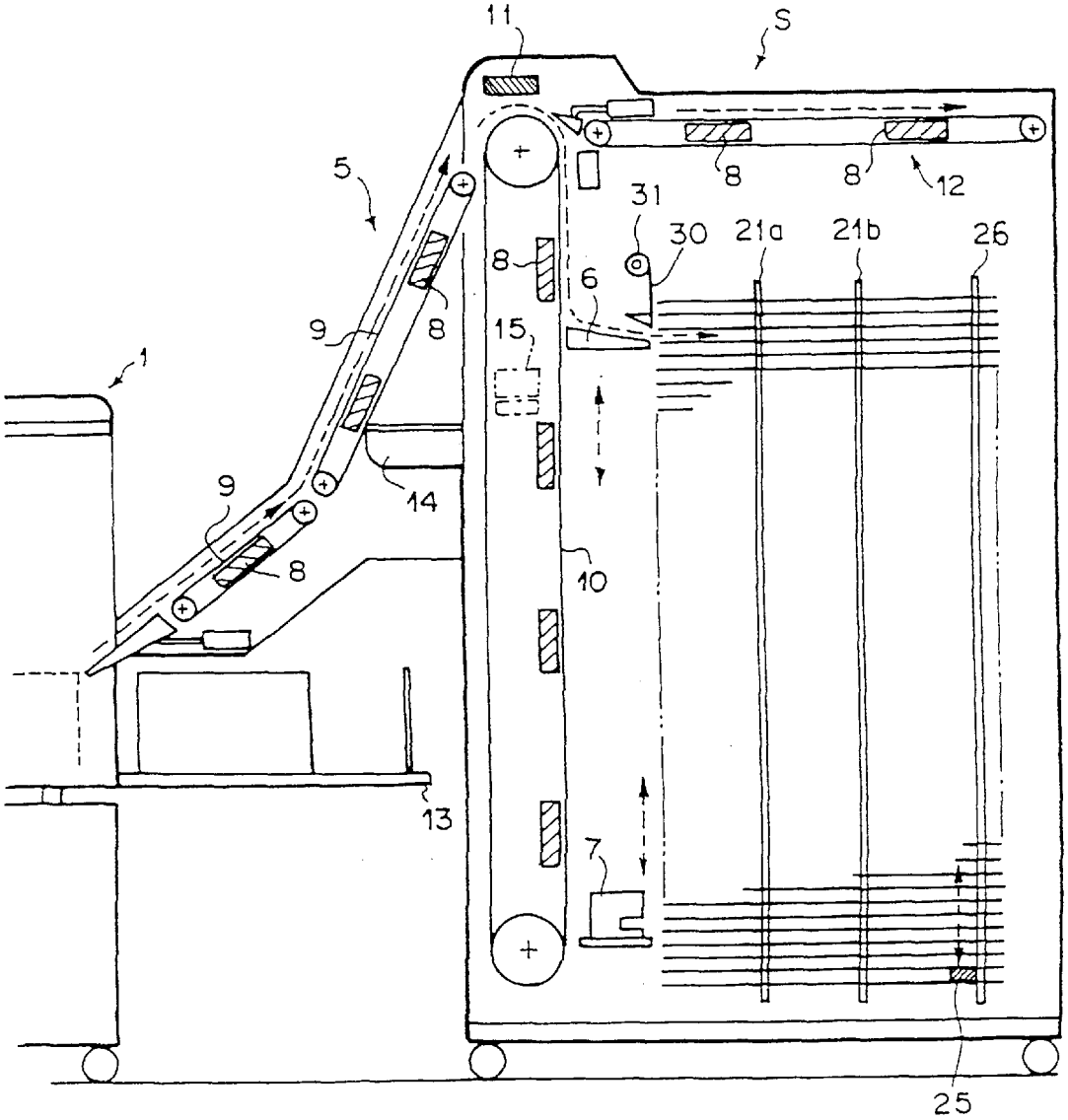
FIG. 2 is a side through-view showing the internal structure of the sorter shown in FIG. 1.

In FIGS. 1 to 4, a sheet sorter S comprises a plurality of (e.g., fifty) bins (sort trays) 4 which are disposed in fixed positions in a frame 3 at predetermined intervals in the vertical direction and receive a plurality of recorded sheets 2 (FIG. 3) discharged from an image recording apparatus 1 such as a printer to form a stack of the sheets 2 on each bin 4, a sheet transfer system 5 which transfers the sheets 2 discharged from the image recording apparatus 1 toward the bins 4, an indexer 6 which is movable up and down along the array of the sheet inlet ends 4*a* of the bins 4 and distributes the sheets 2 transferred by the sheet transfer system 5 to the respective bins 4, and a stapler 7 which is movable along the path of travel of the indexer 6 independently of the indexer 6.

In the case where the image recording apparatus 1 is a printer, especially a stencil printer, a number of sheets can be printed in a short time and recorded sheets 2 carrying thereon wet ink are discharged at a high rate. Accordingly no conveyor roller is used in the sheet transfer system 5 and the sheet transfer system 5 comprises a perforated conveyor belts 9 and 10 which convey the sheets 2 with the back side of the sheets 2 attracted against the belts 9 and 10 under vacuum applied by suction blowers 8 and a fan 11 which presses the sheets 2 against the belt 10 under an air pressure as clearly shown in FIG. 2.

In this particular embodiment, the sheet sorter S is arranged so that a plurality of slaves S' having the same structure as the main sheet sorter S can be connected to the sheet sorter S as shown in FIG. 1 in order to increase the total number of the bins 4. The slaves S' are connected to the main sheet sorter S on the side remote from the image recording apparatus 1. An auxiliary sheet transfer system 12 is demountably mounted on an upper portion of the main sheet sorter S and the sheets 2 in the main sheet sorter S are transferred to the slaves S' by the auxiliary sheet transfer system 12 when the slaves S' are connected to the main sheet sorter S.

The image recording apparatus 1 is provided with a sheet tray 13 on which the discharged sheets 2 are stacked when sorting of the sheets 2 is not necessary. Further a control panel 14 and an exterior electric stapler 15 are mounted on the outer surface of the sheet sorter S.

Figure 3:
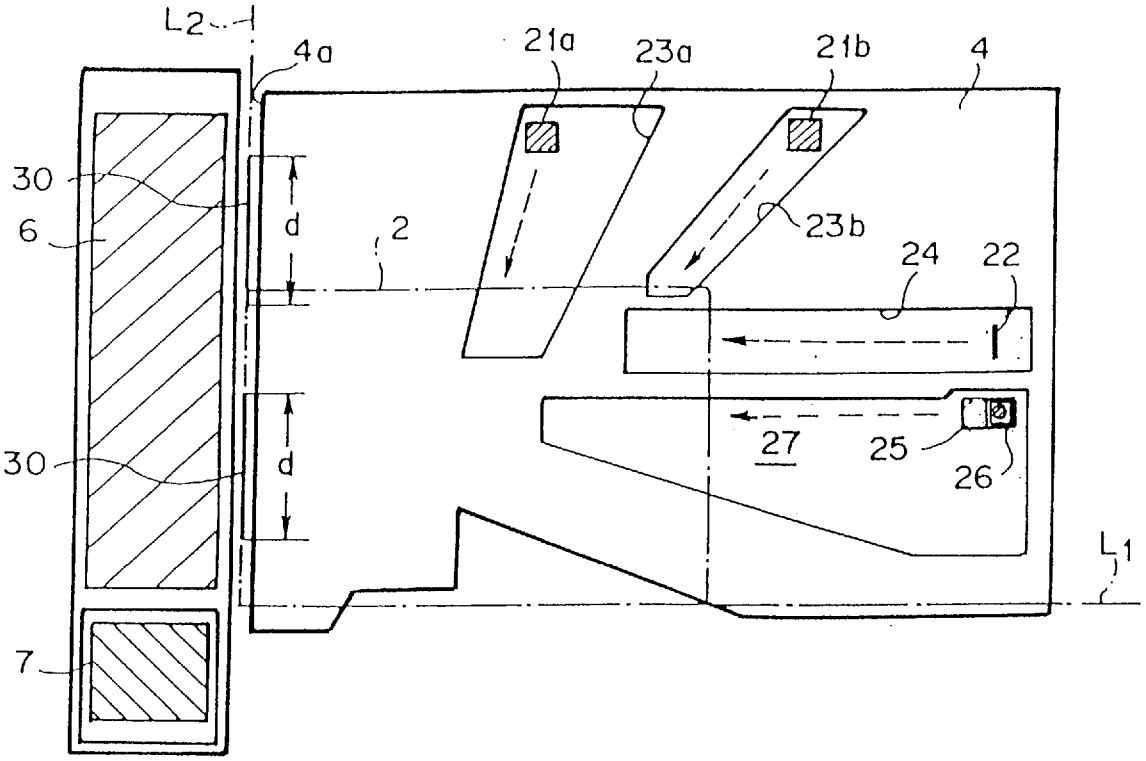
FIG. 3 is a schematic plan view showing the arrangement of the bins, indexer, stapler, sheet stack ejector and the like in the sorter shown in FIG. 1.

As shown in FIG. 3, the stapler 7 waits beside the path of the indexer 6 in a waiting position laterally retracted from the path of travel of the indexer 6 while the indexer 6 is moving up and down. The waiting position of the stapler 7 is such that the indexer 6 is brought into alignment with the stapler 7 in a horizontal direction when the indexer 6 is moved to a position where it can distribute a sheet 2 to the lowermost bin 4.

Figure 4:
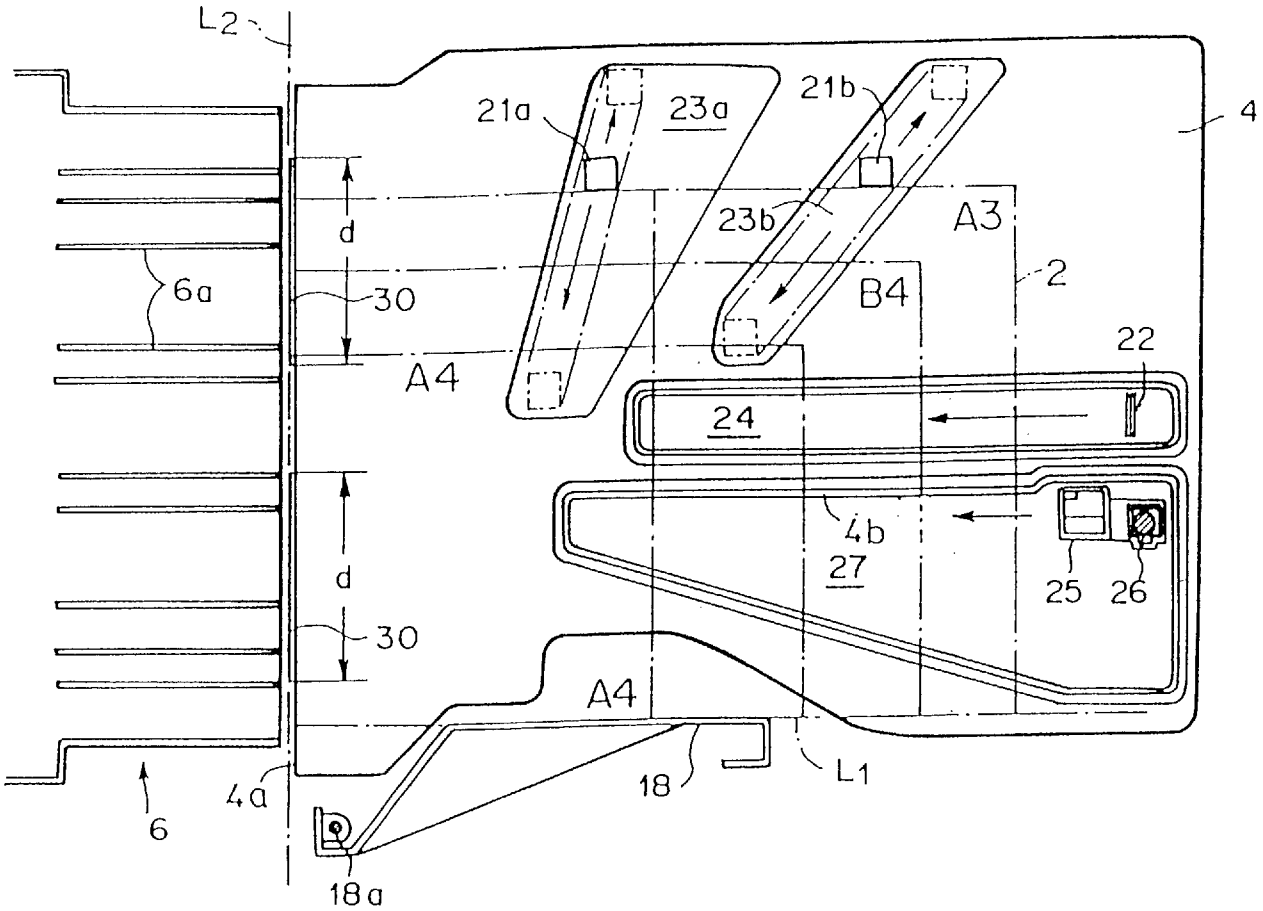
FIG. 4 is an enlarged view of an important part of FIG. 3.

As shown in FIG. 4, side edges of the sheets 2 placed on each bin 4 are lined up along a side edge reference surface L1 defined by the inner surface of a sheet stack take-out door 18 which is rotatable about a pin 18*a*. For this purpose, there vertically extend through the plurality of bins 4 a pair of side lineup rods 21*a* and 21*b* which push the sheet 2 in the direction of width of the sheet 2 and bring the side edge of the sheet 2 into abutment against the side edge reference surface L1, a stopper member 22 of a resilient material such as rubber band which the leading edge of the sheet 2, which is released into the bin 4 at a high speed from the indexer 6, is brought into abutment against, thereby gently stopping the sheet 2, and a guide rail 26 along which a sheet stack ejector 25 (to be described later) is moved up and down.

The side lineup rods 21*a* and 21*b* and the stopper member 22 are moved respectively along slots 23*a*, 23*b* and 24. The stopper member 22 is moved along the slot 24 left and right as seen in FIG. 4 according to the size of the sheets 2 to be released from the indexer 6.

The guide rail 26 doubles as a lineup rod which pushes the leading edge of the sheet 2 to move the sheet 2 toward the sheet inlet end 4*a* of the bin 4 so that the trailing edge of the sheet 2 is brought into abutment against a trailing edge reference surface L2. For this purpose, the guide rail 26 is provided with a flat vertical surface facing toward the sheet inlet end 4*a* of the bin 4. The guide rail 26 is moved left and right as seen in FIG. 4 by a drive mechanism (not shown) in an opening 27 formed in the bin 4.

As shown in FIG. 4, the side lineup rods 21*a* and 21*b* are moved by a drive mechanism (not shown) at angles to the direction in which the sheet 2 is fed into the bin 4 so that they are simultaneously moved toward and away from both the reference surfaces L1 and L2 and can act on various sizes of the sheets 2 in optimum positions according to the size of the sheets 2 handled. Further the angle at which the path of the side lineup rod 21*b*, which is at a larger distance from the trailing edge reference surface L2, is inclined to the feeding direction of the sheet 2 is smaller than that of the other side lineup rod 21*a*, and accordingly as the rods 21*a* and 21*b* are moved toward the side edge of the sheet 2, the distance between the rods 21*a* and 21*b* becomes smaller.

After completion of distribution of the sheets 2 to all the bins 4 by the indexer 6, the sheet stacks 20 (FIG. 5) on the respective bins 4 are ejected toward the stapler 7 beyond the trailing edge reference surface L2 in sequence for stapling operation. For this purpose, a sheet stack ejector 25 is provided. The sheet stack ejector 25 can be moved by a drive mechanism (not shown) up and down in the openings 27 of the respective bins 4 along the guide rail 26 when the guide rail 26 is in the rightmost position shown in FIG. 4.

When the sheet stack 20 on one of the bins 4 is to be stapled, the sheet stack 20 on the bin 4 must be ejected from the sheet inlet end 4*a* of the bin 4 by a predetermined length, and accordingly the sheet stack ejector 25 is provided with an ejecting surface positioned at a distance not smaller than the predetermined length from the vertical surface of the guide rail 26. When the guide rail 26 brings the trailing edges of the sheets 2 into alignment with each other on the trailing edge reference surface L2, the sheet stack ejector 25 is moved upward or downward along the guide rail 26 to a position where the sheet stack ejector 25 does not interfere with the lineup operation of the guide rod 26.

When stapling the sheet stack 20 on a selected bin 4, the sheet stack ejector 25 is first moved along the guide rail 26 to a predetermined position suitable for ejecting the sheet stack 20 on the selected bin 4 and the guide rail 26 is moved toward the sheet inlet end 4*a* of the selected bin 4 from the position shown in FIG. 4. As the guide rail 26 is moved toward the sheet inlet end 4*a*, the sheet stack ejector 25 comes to be engaged with both the upper surface of a linear edge portion 4*b* (FIG. 4) of the opening 27 of the selected bin 4 and the lower surface of the linear edge portion 4*b* of the bin 4 just above the selected bin 4. Thus the sheet stack ejector 25 ejects the sheet stack 20 on the selected bin 4 toward the stapler 7 while moving toward the stapler 7 under the guidance of the surfaces of the engagement portions 4*b* of the adjacent bins 4 held therebetween.

Figure 5:
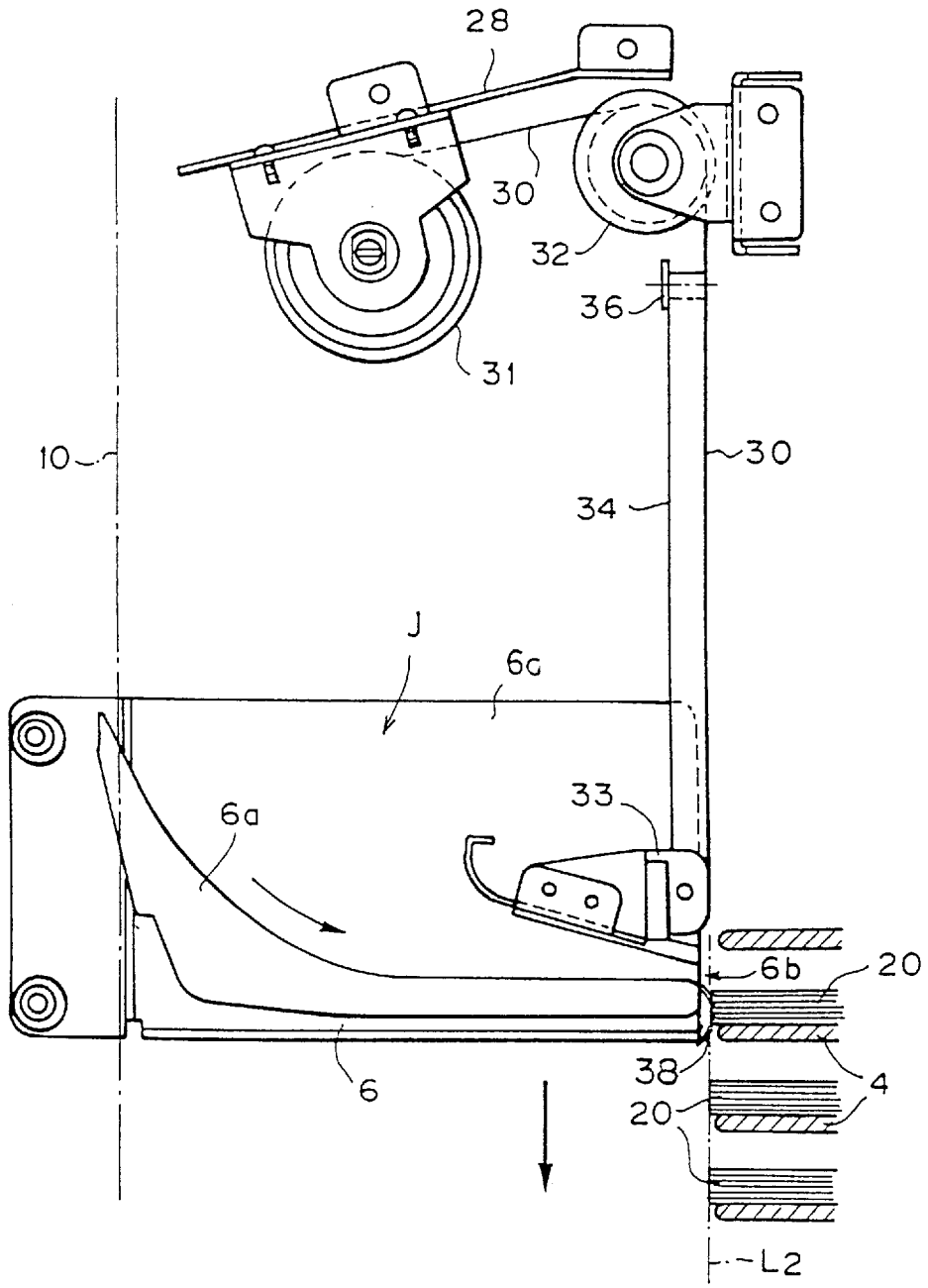
FIG. 5 is a side view showing the member for defining the trailing edge reference surface.
Figure 6:
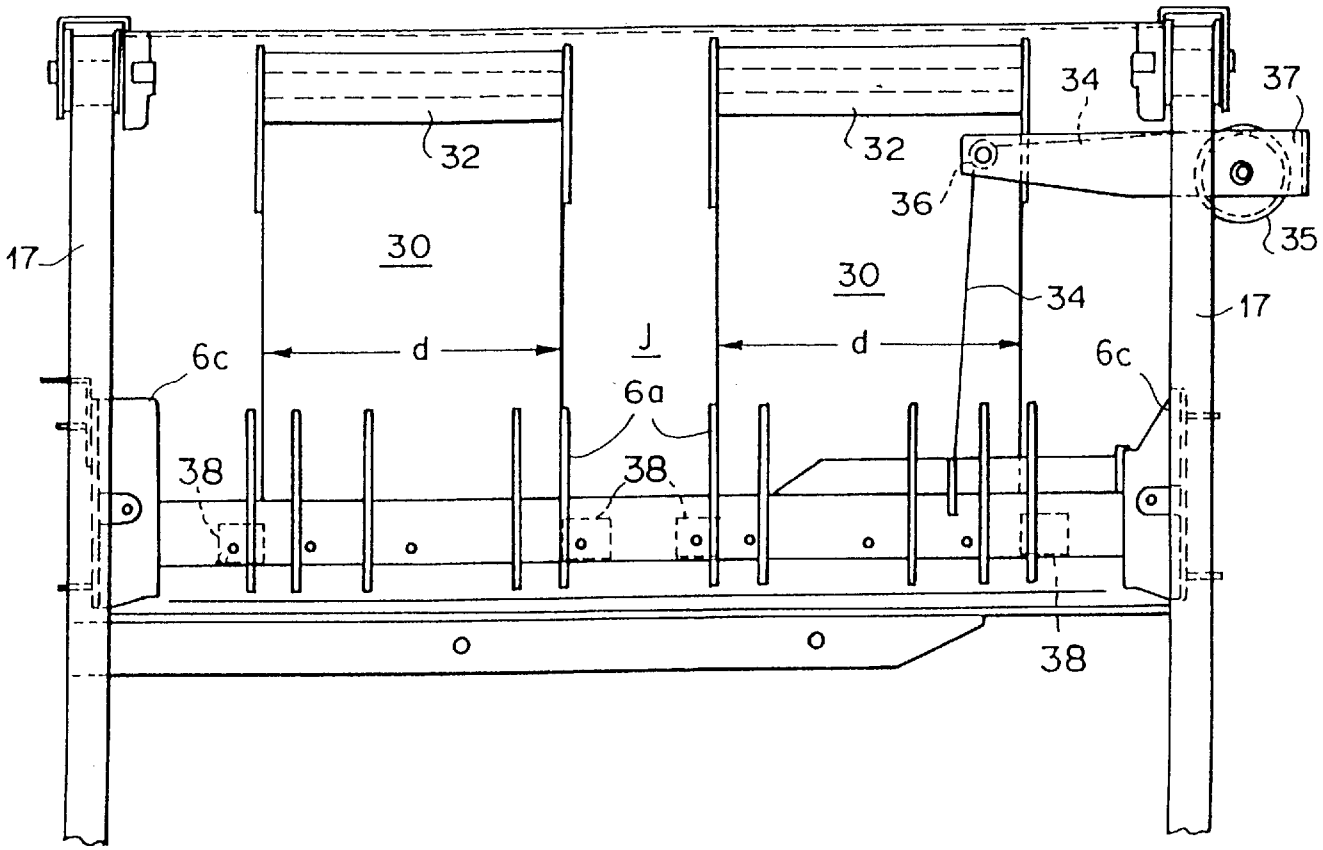
FIG. 6 is a front view as seen from the indexer side showing the same.

FIGS. 5 and 6 show a member for defining the trailing edge reference surface L2. As shown in FIGS. 4 and 6, the trailing edge reference surface L2 extends along the array of the sheet inlet ends 4*a* of the bins 4 and is defined by a pair of strip-like spring members 30 each having a width d. The spring member 30 is in a continuous length and fed out from a roll in a casing 31 (FIG. 5) which is fixed to the frame 3 by way of a bracket 28 above the uppermost position of the indexer 6. The part of the spring member 30 extending outside the casing 31 is passed around a reel 32 and extends right downward. The leading end of the spring member 30 is fixed to a fixing member 33 which is provided just above the sheet discharge port 6*b* of the indexer 6 close thereto.

Accordingly the spring members 30 are long fed out from the casing 31 as the indexer 6 moves downward and close the sheet inlet ends 4*a* of the bins 4 which are above the sheet discharge end 6*b* of the indexer 6, thereby forming the trailing edge reference surface L2. As the indexer 6 moves upward the spring members 30 are taken up into the casing 31.

A sheet resident space J in which all the sheets 2 on the sheet transfer passage of the sheet transfer system 5 are collected when a sheet jam takes place is provided on the indexer 6. In order to hold the sheets 2 in the sheet resident space J, there are provided a pair of side frames 6*c* which are higher than the sheet guide surfaces of a plurality of sheet guide ribs 6*a* provided on the indexer 6 to guide the sheets 2 to the bins 4.

In this particular embodiment, a second strip-like spring member 34 which is smaller than the spring member 30 in width is employed to reinforce the spring member 30, thereby holding flat the spring member 30. That is, as shown in FIG. 6, the second spring member 34 is in a continuous length and fed out from a roll in a casing 35 which is fixed to the frame 3 by way of a bracket 37 so that the longitudinal axis of the casing 35 is substantially perpendicular to that of the casing 31 of the spring member 30. The part of the second spring member 34 extending outside the casing 35 is passed around a reel 36 and extends downward with its one side edge in contact with the indexer side surface of the spring member 30 substantially perpendicularly thereto. The leading end of the second spring member 34 is fixed to the indexer 6 at a portion above the sheet discharge port 6*b* of the indexer 6.

Also the second spring member 34 is fed out from the casing 35 as the indexer 6 moves downward and taken up into the casing as the indexer 6 moves upward. For instance, the second spring member 34 may be of a constant load spring such as "Conston®".

Further in this particular embodiment, as a means for assisting the spring members 32 in lining up the trailing edges of the sheets 2 in the sheet stack 20, hollow resilient members 38 are mounted on the indexer 6 below the sheet discharge port 6*b* on opposite sides of each spring member 20. The hollow resilient members 38 is formed of, for instance, "Mylar®". Each resilient member 38 arcuately bulges toward the bin 4 and has an inclined surface which presses the trailing edge of the sheet stack 20 toward the guide rail 26.

The operation of the sheet sorter S with the arrangement described above will be described, hereinbelow.

Figure 7:
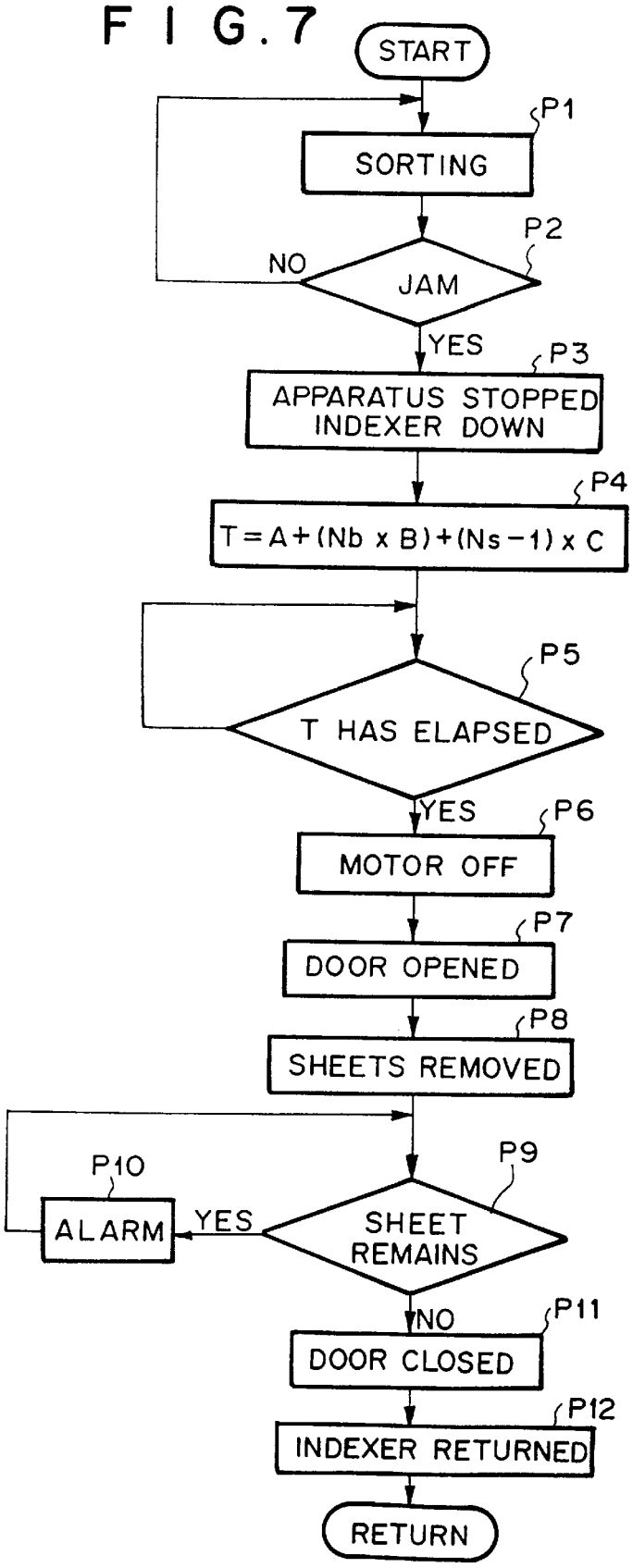
FIG. 7 is a flow chart for illustrating an example of a sheet jam settling processing.
Figure 8:
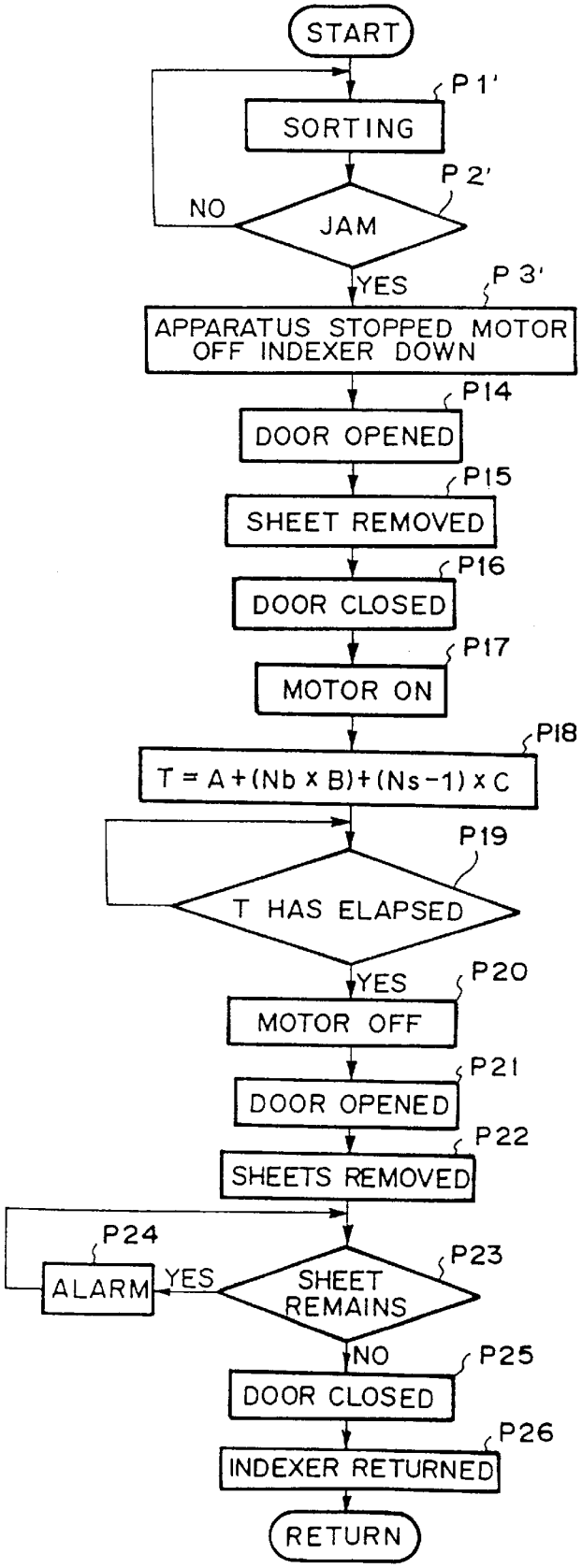
FIG. 8 is a flow chart for illustrating another example of a sheet jam settling processing.

(1) First the indexer 6 is located in a position where the sheet discharge port 6*b* thereof is opposed to the sheet inlet end 4*a* of the uppermost bin 4 with the stapler 7 held in the waiting position laterally retracted from the path of the indexer 6 shown in FIGS. 6 to 8. At this time, the side lineup rods 21*a* and 21*b* are held in the respective retracted positions at a maximum distance from the side edge reference surface L1 and the stopper 22 is held in a position corresponding to the size of the sheets 2 to be discharged from the image recording apparatus 1. Further the guide rail 26 is held in the position shown in FIG. 4 with the sheet stack ejector 25 held in the opening 27 of the lowermost bin 4.

(2) Assuming that the image recording apparatus 1 prints forty documents each of twenty pages, the image recording apparatus 1 first discharges forty sheets 2 of page 20. Accordingly, while moving downward, the indexer 6 distributes one sheet 2 of page 20 to each bin 4 up to the fortieth bin 4 as numbered from above. The sheet 2 released into each bin 4 slides on the bin 4 and is stopped by the stopper member 22.

(3) At the time distribution of the sheets 2 of page 20 to the forty bins 4 is completed, the sheet inlet end 4*a* of the fortieth bin 4 is kept open though the sheet inlet ends 4*a* of the first (uppermost) to thirty-ninth bins 4 have been closed by the spring members 30. Accordingly, the indexer 6 is further moved downward by a small distance, thereby closing the sheet inlet end 4*a* of the fortieth bin 4 by the spring members 30.

(4) Thereafter the side lineup rods 21*a* and 21*b* are moved toward both the reference surfaces L1 and L2, thereby bringing the side edge of the sheet 2 in each bin 4 into alignment with the reference surface L1 while the guide rail 26 is moved toward the sheet inlet ends 4*a* of the bins 4, thereby bringing the trailing edge of the sheet 2 in each bin 4 into abutment against the spring members 30 or into alignment with the reference surface L2.

(5) Then the indexer 6 is returned upward to the position where the sheet discharge port 6*b* thereof is opposed to the sheet inlet end 4*a* of the uppermost bin 4 and distributes one sheet 2 of page 19 to each bin 4 up to the fortieth bin 4 to be superposed on the sheet 2 of page 20 in the similar manner. In this manner, a sheet stack 20 of sheets 2 of pages 1 to 20 is formed on each of the first to fortieth bins 4.

(6) Each time the indexer 6 is moved upward, the inclined surfaces of the hollow resilient members 38 are brought into contact with the trailing edges of the sheet stacks 20 on the respective bins 4 in sequence, thereby lining up the trailing edges of the sheets 2 in each stack 20.

(7) When formation of a sheet stack 20 of sheets 2 of pages 1 to 20 on each of the first to fortieth bins 4 is thus completed, the guide rail 26 is returned to the position shown in FIG. 4. Further the indexer 6 is moved upward beyond the position shown in FIG. 6 so that the sheet inlet ends 4*a* of all the bins 4 are opened.

(8) Following the upward movement of the indexer 6, the stapler 7 is moved upward and in the direction of width of the sheet stack 20 to a position where the throat 7*a* of the stapler 7 is opposed to a predetermined stapling position of the sheet stack 20 in the uppermost bin 4, and at the same time, the sheet stack ejector 25 is moved upward into the opening 27 of the uppermost bin 4. Thereafter the guide rail 26 is moved toward the sheet inlet end 4*a* of the bin 4 so that the sheet stack ejector 25 ejects the sheet stack 20 on the uppermost bin 4 beyond the reference surface L2 by a predetermined length, whereby the trailing edge of the sheet stack 20 is inserted into the throat 7*a* of the stapler 7. That the trailing edge of the sheet stack 20 is in the throat of the stapler 7 is detected by a detector (not shown) and the stapler 7 automatically staples the sheet stack 20.

(9) Thereafter the guide rail 26 is returned to the original position together with the sheet stack ejector 25 and the stapler 7 is moved in the direction of width of the sheet stack 20 to center a reciprocal sheet pusher member (not shown) provided on the stapler 7 with respect to the edge of the stapled sheet stack 20. Then the sheet pusher member is actuated to push the stapled sheet stack 20 into the bin 4.

(10) Then the stapler 7 is moved downward to a position where the throat 7*a* of the stapler 7 is opposed to the sheet stack 20 in the second uppermost bin 4, and at the same time, the sheet stack ejector 25 is brought into the opening 27 of the thirty-ninth bin 4. Thereafter the guide rail 26 is moved toward the sheet inlet end 4*a* of the bin 4 so that the sheet stack ejector 25 ejects the sheet stack 20 on the second uppermost bin 4 beyond the reference surface L2 by the predetermined length, whereby the trailing edge of the sheet stack 20 is inserted into the throat 7*a* of the stapler 7. Then the stapler 7 automatically staples the sheet stack 20 and the guide rail 26 is returned to the original position together with the sheet stack ejector 25 and the sheet pusher member on the stapler 7 pushes the stapled sheet stack 20 into the bin 4.

(11) In this manner, the sheet stacks 20 on all the bins 4 are stapled and after completion of the stapling operation, the stapler 7 is returned to the waiting position. Then the sheet stack take-out door 18 is opened and the stapled sheet stacks are taken out.

Figure 9:
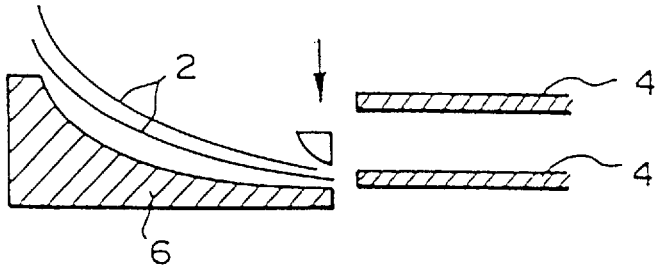
FIG. 9 is a view for illustrating the position where the indexer is moved upon detection of the sheet jam.

An example of a sheet jam settling processing which is to be effected when a sheet jam takes place about the indexer 6 will be described with reference to FIG. 7, hereinbelow. When a sheet jam takes place while sorting of sheets 2 are effected, the controller of the sheet sorter S outputs a stop instruction signal to the image recording apparatus 1, thereby stopping the image recording apparatus 1 from discharging the recorded sheets 2 to the sheet sorter S. At the same time the controller moves down the indexer 6 to a position where the sheet discharge port 6*b* thereof is opposed right to the bottom of the bin 4, into which the indexer 6 was about to release the sheet 2, as shown in FIG. 9 and holds the indexer 6 in the position, thereby blocking the sheet discharge port 6*b*. (steps P1 to P3) However the controller keeps the sheet transfer system 5 of the sheet sorter S operating so that the sheets 2 on the sheet transfer passage are collected in the sheet resident space J.

That is, the controller sets a timer T according to the following formula. (step P4)

$$T=A+(Nb\times B)+(Ns-1)\times C$$

wherein A represents a time interval obtained by adding a certain allowance time α to the time which the sheet transfer system 5 takes to transfer the sheet 2 from the inlet of the sheet transfer passage to the uppermost pin 4, B represents the time interval obtained by adding a certain allowance time β to the time which the sheet transfer system 5 takes to transfer the sheet 2 by a bin-to-bin distance, Nb represents the number of bins which the indexer 6 is opposed to at the time the sheet jam is detected as numbered from the uppermost bin in each of the columns of the bins (the main sorter S and the slaves S'), Ns represents the number of the columns of the bins in which the indexer 6 is operating at the time the sheet jam is detected as numbered from the side adjacent to the image recording apparatus 1 and C represents the time interval obtained by adding a certain allowance time γ to the time which the sheet 2 takes to pass the auxiliary sheet transfer system 12.

When no slave S' is used, the above formula is rewritten as follows.

$$T=A+(Nb\times B)$$

The times A, B and C vary in proportion to the transfer speeds.

When the time T has elapsed, the controller stops the motor of the sheet transfer system 5. (steps P5 and P6)

Then the operator opens a door (not shown) of the sheet sorter S which gives access to the sheet resident space J and the sheet transfer passage of the sheet transfer system 5 and removes the sheets 2 in the sheet resident space J. (steps P7 and P8) When the door is opened, the controller keeps activating an alarm so long as there remains any sheet 2 in the sheet resident space J and/or the sheet transfer passage of the sheet transfer system 5. (steps P9 and P10) Whether there remains any sheet 2 in the sheet resident space J and/or the sheet transfer passage of the sheet transfer system 5 is detected by sensors (not shown) disposed in the sheet resident space J and the sheet transfer passage of the sheet transfer system 5. After removing the sheets 2 in the sheet resident space J and the sheet 2 in the sheet transfer passage of the sheet transfer system 5 (if any), the operator closes the door. (step P11) When closure of the door is detected, the controller returns the indexer 6 to the original position in which the indexer 6 was at the occurrence of the sheet jam. (step P12) Steps P9 and P10 ensure that the indexer 6 is never returned to the original position so long as there remains any sheet 2 in the sheet resident space J and/or the sheet transfer passage of the sheet transfer system 5, thereby preventing a sheet 2 which has been left in the sheet resident space J and/or the sheet transfer passage from being released into a bin 4.

Figure 10:
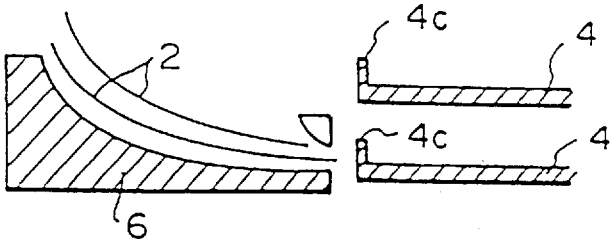
FIG. 10 is a view showing a modification of the bin.

In order to more surely prevent a sheet 2 which has been left in the sheet resident space J and/or the sheet transfer passage from being released into a bin 4, it is preferred that each bin 4 is provided with an erected surface 4*c* as shown in FIG. 10. In this case, the erected surface 4*c* may be arranged to double as a member for defining the trailing edge reference surface L2 and the spring members 30 34 may be omitted.

In the sheet sorter S of this embodiment, when a sheet jam takes place about the indexer 6, the sheet transfer system 5 is kept operating for the time interval T though the image recording apparatus 1 and the indexer 6 are immediately stopped, and accordingly all the sheets 2 on the sheet transfer passage are collected in the sheet resident space J and can be removed in a lump.

Further by setting the time interval T according to the above formula, the time for which the sheet transfer system 5 is kept operating can be minimized. However the time interval T may be fixed according to the following formula.

$$T=A+(\text{maximum number of bins}\times B)+(\text{maximum number of slaves}-1)\times C$$

Another example of a sheet jam settling processing which is to be effected when a sheet jam takes place about the indexer 6 will be described with reference to FIG. 8, hereinbelow. In FIG. 8, steps P1' to P3' are the same as steps P1 to P3 in FIG. 7. However in this example, when a sheet jam is detected, the sheet transfer system 5 is once stopped as well as the image recording apparatus 1. Then the operator opens the door of the sheet sorter S (step P14) and removes the sheet 2 jammed in the indexer 6 (step P15). When the operator subsequently closes the door (step P16), the controller restarts the sheet transfer system 5 with the indexer 6 held in the position shown in FIG. 9 (step P17) and keeps the sheet transfer system 5 operating for the time interval T, whereby all the sheets 2 on the sheet transfer passage of the sheet transfer system 5 are collected in the sheet resident space J (steps P17 to P20).

Then the operator opens the door of the sheet sorter S and removes the sheets 2 in the sheet resident space J in the lump. (steps P21 and P22) As in the preceding example, when the door is opened, the controller keeps activating an alarm so long as there remains any sheet 2 in the sheet resident space J and/or the sheet transfer passage of the sheet transfer system 5. (steps P23 and P24) After removing the sheets 2 in the sheet resident space J and the sheet 2 in the sheet transfer passage of the sheet transfer system 5 (if any), the operator closes the door. (step P25) When closure of the door is detected, the controller returns the indexer 6 to the original position in which the indexer 6 was at the occurrence of the sheet jam. (step P26) Steps P23 and P24 ensure that the indexer 6 is never returned to the original position so long as there remains any sheet 2 in the sheet resident space J and/or the sheet transfer passage of the sheet transfer system 5, thereby preventing a sheet 2 which has been left in the sheet resident space J and/or the sheet transfer passage from being released into a bin 4.

Figure 11:
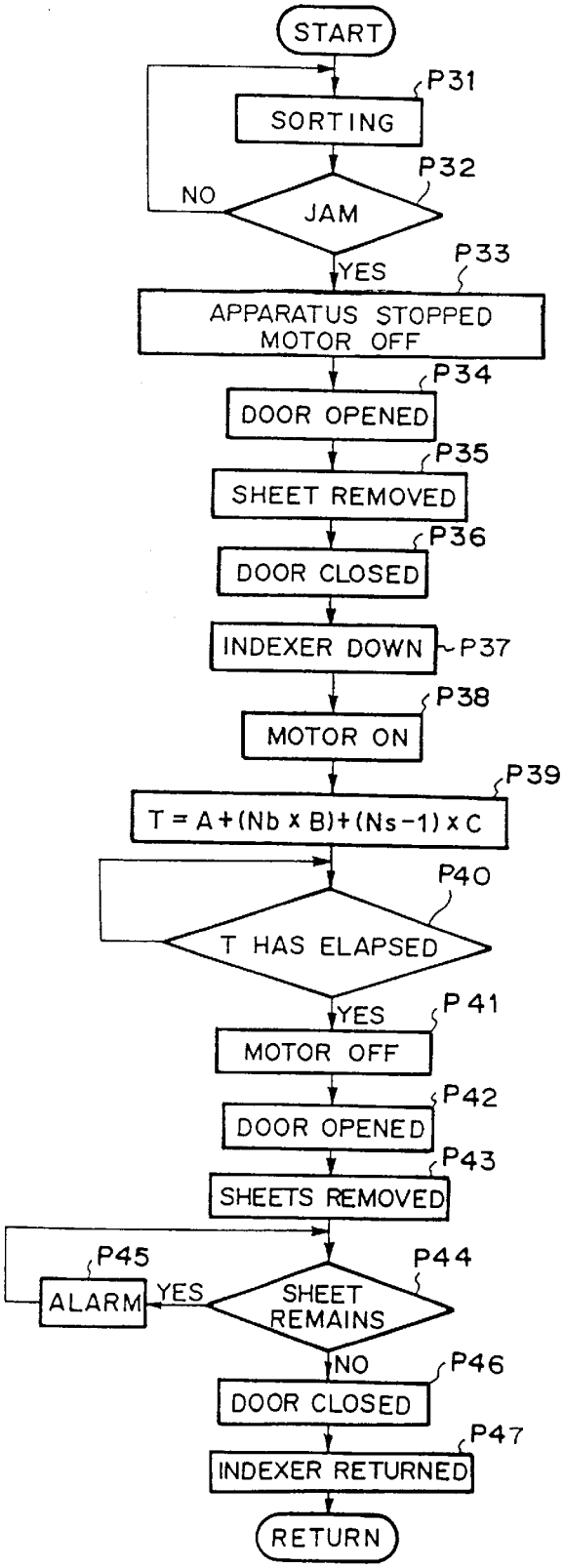
FIG. 11 is a flow chart for illustrating a modification of the sheet jam settling processing shown in FIG. 8.

The indexer 6 may be moved to the position shown in FIG. 9 after the sheet 2 jammed in the indexer 6 is removed as shown in FIG. 11.

As can be understood from the description above, in accordance with the present invention, when a sheet jam takes place about the indexer, the sheet transfer system 5 is operated for a predetermined time so that all the sheets in the sheet transfer passage are collected in the sheet resident space though the sheet recording apparatus is immediately stopped. Accordingly all the sheets in the sheet transfer passage can be removed in the lump without removing them one by one.

Further by setting the predetermined time interval according to the position of the indexer, loss time can be shortened.

Further by moving down the indexer to a position where the sheet discharge port thereof is opposed right to the bottom of the bin as soon as a sheet jam takes place and holding the indexer in the position until that there remains no sheet in the sheet resident space and/or the sheet transfer passage of the sheet transfer system is confirmed, a sheet which has been left in the sheet resident space and/or the sheet transfer passage is prevented from being released into a bin by accident.

What is claimed is:

1. A sheet sorter comprising a plurality of bins arranged in a vertical direction each of which receives a plurality of sheets discharged from an image recording apparatus and forms thereon a stack of sheets, a sheet transfer system which transfers the sheets discharged from the image recording apparatus, an indexer, and a means for moving the indexer up and down along the array of sheet inlet ends of the bins to distribute the sheets from the sheet transfer system to the respective bins through the sheet inlet ends thereof, wherein the improvement comprises a sheet resident space provided on the indexer, and a control means which stops the image recording apparatus upon detection of a sheet jam about the indexer and stops the sheet transfer system after keeping it operating for a predetermined time interval sufficient for the sheet transfer system to transfer all the sheets in a sheet transfer passage thereof to the sheet resident space.

2. A sheet sorter as defined in claim 1 in which said sheet resident space is defined by a guide member of the indexer which supports the under side of the sheet and guides the sheet into the bin and a pair of side frames which are disposed on opposite sides of the guide member and extend higher than the guide surface of the guide member.

3. A sheet sorter as defined in claim 1 in which said predetermined time interval is set according to the position of the indexer at the time the sheet jam is detected.

4. A sheet sorter as defined in claim 3 in which said bins are arranged in a plurality of columns and said predetermined time interval is set according to the number of bins which the indexer is opposed to at the time the sheet jam is detected as numbered from the uppermost bin in each column and the number of the column in which the indexer is operating at the time the sheet jam is detected as numbered from the side adjacent to the image recording apparatus.

5. A sheet sorter as defined in claim 1 in which the control means moves the indexer immediately after detection of the sheet jam to a position where the sheet discharge port thereof is blocked by the bottom of the bin into which the indexer was about to release the sheet upon detection of the sheet jam and holds the indexer in the position until that there remains no sheet in the sheet resident space and/or the sheet transfer passage of the sheet transfer system is confirmed.

6. A sheet sorter as defined in claim 5 in which the sheet inlet end of each bin be provided with an erected surface.

7. A sheet sorter as defined in claim 6 in which the erected surface doubles as a means for defining a reference surface on which the trailing edges of the sheets stacked in each bin are aligned with each other.

8. A sheet sorter comprising a plurality of bins arranged in a vertical direction each of which receives a plurality of sheets discharged from an image recording apparatus and forms thereon a stack of sheets, a sheet transfer system which transfers the sheets discharged from the image recording apparatus, an indexer, and a means for moving the indexer up and down along the array of sheet inlet ends of the bins to distribute the sheets from the sheet transfer system to the respective bins through the sheet inlet ends thereof wherein the improvement comprises that a sheet resident space provided on the indexer, and a control means which stops the image recording apparatus and the sheet transfer system upon detection of a sheet jam about the indexer, blocks the sheet discharge port of the indexer, restarts the sheet transfer system upon receipt of a signal representing that the sheet jam is settled and a signal representing that the sheet discharge port of the indexer is blocked, and keeps the sheet transfer system operating for a predetermined time interval sufficient for the sheet transfer system to transfer all the sheets in a sheet transfer passage thereof to the sheet resident space.

9. A sheet sorter as defined in claim 8 in which said sheet resident space is defined by a guide member of the indexer which supports the under side of the sheet and guides the sheet into the bin and a pair of side frames which are disposed on opposite sides of the guide member and extend higher than the guide surface of the guide member.

10. A sheet sorter as defined in claim 8 in which said predetermined time interval is set according to the position of the indexer at the time the sheet jam is detected.

11. A sheet sorter as defined in claim 8 in which said bins are arranged in a plurality of columns and said predetermined time interval is set according to the number of bins which the indexer is opposed to at the time the sheet jam is detected as numbered from the uppermost bin in each column and the number of the column in which the indexer is operating at the time the sheet jam is detected as numbered from the side adjacent to the image recording apparatus.

12. A sheet sorter as defined in claim 8 in which the control means moves the indexer immediately after detection of the sheet jam to a position where the sheet discharge port thereof is blocked by the bottom of the bin into which the indexer was about to release the sheet upon detection of the sheet jam and holds the indexer in the position until that there remains no sheet in the sheet resident space and/or the sheet transfer passage of the sheet transfer system is confirmed.

13. A sheet sorter as defined in claim 12 in which the sheet inlet end of each bin be provided with an erected surface.

14. A sheet sorter as defined in claim 13 in which the erected surface doubles as a means for defining a reference surface on which the trailing edges of the sheets stacked in each bin are aligned with each other.

15. A sheet sorter as defined in claim 8 in which the control means moves the indexer to a position where the sheet discharge port thereof is blocked by the bottom of the bin, into which the indexer was about to release the sheet upon detection of the sheet jam, after the sheet jammed in the indexer is removed and before the sheet transfer system is restarted, and holds the indexer in the position until that there remains no sheet in the sheet resident space and/or the sheet transfer passage of the sheet transfer system is confirmed.

16. A sheet sorter as defined in claim 15 in which the sheet inlet end of each bin be provided with an erected surface.

17. A sheet sorter as defined in claim 16 in which the erected surface doubles as a means for defining a reference surface on which the trailing edges of the sheets stacked in each bin are aligned with each other.

* * * * *